US006432164B1

(12) United States Patent
Kunitake et al.

(10) Patent No.: US 6,432,164 B1
(45) Date of Patent: Aug. 13, 2002

(54) METHOD FOR REFINING MOLTEN STEEL AND APPARATUS THEREFOR

(75) Inventors: Okitomo Kunitake; Norio Omura; Wataru Sakai; Susumu Mukawa; Tadashi Imai, all of Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/763,044

(22) PCT Filed: May 12, 2000

(86) PCT No.: PCT/JP00/03075

§ 371 (c)(1),
(2), (4) Date: Feb. 15, 2001

(87) PCT Pub. No.: WO00/77264

PCT Pub. Date: Dec. 21, 2000

(30) Foreign Application Priority Data

Jun. 16, 1999 (JP) ..... 11-169706
Jul. 29, 1999 (JP) ..... 11-215205

(51) Int. Cl.[7] ..... C21C 7/10
(52) U.S. Cl. ..... 75/511; 266/210
(58) Field of Search ..... 75/511; 266/210

(56) References Cited

FOREIGN PATENT DOCUMENTS

| | | | |
|---|---|---|---|
| EP | 0 881 304 | * | 2/1988 |
| JP | 62-205221 | | 9/1987 |
| JP | 01-156416 | | 6/1989 |
| JP | 02-122013 | | 5/1990 |
| JP | 04-285111 | | 10/1992 |
| JP | 05-98340 | | 4/1993 |
| JP | 05-320739 | | 12/1993 |
| JP | 08-109411 | | 4/1996 |
| JP | 09-157730 | | 6/1997 |
| JP | 09-256025 | | 9/1997 |
| JP | 09-287016 | | 11/1997 |
| JP | 09-287017 | | 11/1997 |
| JP | 11-50132 | | 2/1999 |

* cited by examiner

*Primary Examiner*—Melvyn Andrews
(74) *Attorney, Agent, or Firm*—Kenyon & Kenyon

(57) ABSTRACT

A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and decarburizing and refining the molten steel under a reduced pressure, characterized in that the method comprising the steps of; controlling the pressure Pt (Torr) in the cylindrical immersion tube so as to satisfy the following formulae (1) and (2), blowing oxygen gas to the surface of the molten steel through the lance, and decarburizing and refining the molten steel under a reduced pressure;

$$Pt>760-1.297\times10^{7}/Dc^{2} \quad (1)$$

$$K=1.71\times Dl^{0.211}\times Dc^{0.438}\times Wm^{-1.124}\times Qg^{0.519}\times Pt^{-0.410}>0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

6 Claims, 5 Drawing Sheets

METHOD FOR REFINING MOLTEN STEEL AND APPARATUS THEREFOR

TECHNICAL FIELD

This invention relates to a method for refining molten steel inexpensively and efficiently and, more specifically, to a method for decarburizing, desulfurizing or dephosphorizing molten steel inexpensively and efficiently and a refining apparatus employed for implementing said method.

BACKGROUND ART

Requirements for steel material properties are becoming more and more demanding as steel materials are used in more severe environments. Since steel materials are widely used in the society in general, they are required to be inexpensive, too. For manufacturing steel materials having desired properties, it is necessary to lower impurities such as phosphorus, sulfur, carbon, hydrogen, etc. to the least possible amounts at steel refining processes, and it is also important to refine steel inexpensively. In this situation, it is essential to clarify the physical and chemical fundamentals and principles of steel refining reactions and develop efficient refining methods and apparatuses based thereon.

Conventionally, the technical trend of steel refining has been to divide the refining process into steps so that each of impurities has been removed under a condition tailored to facilitate the removal and to complete the steel refining through several steps. Technologies based on this philosophy have come to be widely practiced. For example, widely employed is a hot metal treatment process wherein the dephosphorizing treatment and the decarburizing treatment, which were formerly carried out using only a converter, have been divided into the dephosphorizing treatment at the step of molten pig iron and the decarburizing treatment in a converter.

At the decarburizing treatment in a converter, carbon is removed through oxidation by injecting oxygen into molten steel (oxidizing refining), but the oxygen is inevitably absorbed in the molten steel.

Oxygen concentration in molten steel becomes high especially when producing low carbon steels having a carbon concentration of 0.1% or less: for example, if blowing is stopped at a carbon concentration of 0.04%, oxygen content in the molten steel will be 0.05% or so. The carbon concentration and the oxygen concentration in molten steel are roughly in inverse proportion to each other and, hence, the lower the end point carbon concentration, the higher the oxygen concentration.

In the meantime, highly formable ultra low carbon steels have come to be used in large quantities especially for exposed panels for automobiles. For producing the ultra low carbon steels, it is necessary to lower the carbon concentration to a level of 30 ppm or less and, for this purpose, decarburizing treatment is carried out by decompression refining at a secondary refining stage after the decarburization in a converter.

At the present time, when the continuous casting method has become general, in order to prevent the occurrence of pin holes and breakouts caused by CO gas generated during casting, it is necessary to remove oxygen absorbed in molten steel by adding a deoxidizing agent, typically Al, to molten steel and trapping the oxygen as oxides. When the deoxidizing agent is entrapped in steel materials, however, it will undesirably cause cracks and defects when they are plated.

Further, the deoxidizing agent remaining in steel materials tends to appear as inclusion-induced defects in the case of low carbon steels often used as materials for stamping applications undergoing intensive working. A process to produce low carbon steels with low oxygen concentration, therefore, needs to be developed.

In this respect, a method called the carbon deoxidation method is widely known, wherein the oxygen in molten steel is removed in the form of CO gas by carbon in the molten steel. In this method a vacuum degassing apparatus equipped with a large evacuator (for example, an RH vacuum degasser) is generally employed for an effective decarburizing action.

Japanese Unexamined Patent Publication No. S53-16314, for example, discloses a method to produce Al-killed molten steel for continuous casting use wherein the end point carbon concentration at a converter is controlled to 0.05% or more and a degassing treatment is applied using a vacuum degasser before deoxidation. By this method, the pressure inside a vacuum tank is controlled within the range of 10 to 300 Torr in accordance with the progress of decarburization. Further, Japanese Unexamined Patent Publication No. H6-116626 discloses a decarburization method, with a reduced occurrence of splash, wherein molten steel in a ladle with carbon concentration reduced in a converter to 0.1 to 1.0% is decarburized by immersing a single cylindrical immersion tube into the molten steel and injecting oxygen mixed with an inert gas under a pressure of 100 Torr or more.

The methods disclosed in the Japanese Unexamined Patent Publication Nos. S53-16314 and H6-116626, however, employ so-called large decompression refining apparatuses. In the method of the Japanese Unexamined Patent Publication No. S53-16314, it is necessary to reduce the pressure to 10 Torr or so, and hence a large vacuum degasser such as a vapor jet vacuum pump is indispensable. In the method of the Japanese Unexamined Patent Publication No. H6-116626 wherein oxygen gas mixed with an inert gas is used for decarburization, on the other hand, there is a problem that expensive argon gas has to be used since, when inexpensive nitrogen gas is used instead, it is absorbed in steel adversely affecting its aging properties.

At the present time, when vacuum degassers are widely used for the purposes of decarburization and dehydrogenation of ultra low carbon steels, the degassers originally designed for degassing at a high vacuum of 1 Torr or less are often used for the production of low carbon steels. However, a high decompression refining apparatus such as an RH vacuum degasser (hereinafter sometimes called "an RH refining apparatus") has a vacuum tank very large in height and diameter and, consequently, the volume to be evacuated is huge. For this reason, there are problems of high refining costs due to high unit consumption of refractories and high costs of utilities such as steam for a vapor jet vacuum pump required for evacuation.

Another problem is that the construction of a large decompression refining apparatus intended for the carbon deoxidation of low carbon steels is expensive and uneconomical. Further, a high decompression refining apparatus is used for producing ultra low carbon steels with a carbon concentration of, for example, 30 ppm or less and, in this case, skulls of a high carbon concentration which adhered onto the inner wall of a vacuum tank when molten steel with a carbon concentration of 0.04% or so, which is a far higher carbon concentration than an ultra low carbon steel, is processed, re-melt during the processing of an ultra low carbon steel and become the source of carbon contamination. This leads to another problem of longer decarburizing treatment time or no progress in decarburization. Some RH refining apparatuses are equipped with an LPG burner for melting and removing the skulls as a countermeasure, but such a countermeasure leads to another problem of additional costs for the equipment and the removal operation.

Looking at the desulfurizing treatment of molten steel, it is classified, generally, into hot metal desulfurization applied in the state of molten pig iron and molten steel desulfurization applied in the state of molten steel. As steel materials came to be used in more severe conditions, the required level of steel purity becomes higher. As a consequence, the application of only the hot metal desulfurization can be regarded insufficient and the molten steel desulfurization is an indispensable process step. Thus, the development of a method for efficient desulfurization and an apparatus therefor, especially for producing ultra low sulfur steels having an S concentration of 10 ppm or less, has been required.

As a response, for example, Japanese Unexamined Patent Publication No. S58-37112 proposes a method to immerse an immersion tube (the upleg snorkel of an RH refining apparatus) equipped with a powder injection lance into molten steel in a ladle, and to inject a desulfurizing agent together with a carrier gas toward the immersion tube.

However, although it is possible to lower the S concentration of molten steel to 10 ppm or less by this method, a treatment process employing such a vacuum degasser has a problem of high operation costs for steam, electricity, etc., because a vacuum degasser such as an RH refining apparatus has a huge evacuator for maintaining a high vacuum of 1 Torr or so. There is another problem of high refractory costs because the vacuum degassing tank has to be very tall and large to cope with the violent splashing occurring during the course of the processing.

A ladle refining vessel such as an LF is also capable of reducing the S concentration of molten steel to a level attainable by the RH process, i.e., 10 ppm or less, but this method has problems of high operation costs and a low productivity due to the protracted processing time.

As another solution, a desulfurization method has been proposed wherein an immersion tube equipped with a powder injection lance is immersed into molten steel in a ladle and a desulfurizing agent is injected together with a carrier gas. Although lower in operating cost than the desulfurizing treatment using an RH apparatus, the proposed method accelerates resulfurization by the agitation of slag, which has no desulfurization capability, on the molten steel surface and it is difficult to stably produce ultra low sulfur steels with an S concentration of 10 ppm or less.

Next, looking at the dephosphorizing treatment of molten steel, the degassing and dephosphorizing method proposed in Japanese Unexamined Patent Publication No. S62-205221 can be cited as an example of conventional methods to dephosphorize molten steel. The method is characterized by injecting a dephosphorizing agent in powder from into molten steel having 100 to 800 ppm of free oxygen through a powder injection tuyere provided at a lower part of a vacuum degassing tank. However, since a characteristic of the vacuum degasser employed herein is such that a decarburizing reaction takes place in parallel with the dephosphorizing reaction and the decarburizing reaction proceeds preferentially, there is a shortcoming that the dephosphorizing reaction speed is lowered.

Facing this situation, Japanese Unexamined Patent Publication No. H2-122013 proposed a new degassing and dephosphorizing method, which was characterized in that the degree of vacuum in a degassing tank was controlled during the degassing and dephosphorizing process in accordance with C concentration level of molten steel. Because of a characteristic of an RH vacuum degasser herein employed, however, the control range of the degree of vacuum where the molten steel processing is viable is usually 150 Torr or less, and the decarburizing reaction proceeds still preferentially at this level of degree of vacuum. Although the proposed method is superior to the method proposed in the Japanese Unexamined Patent Publication No. S62-205221 in terms of dephosphorizing reaction, it has a problem that a sufficient dephosphorizing speed is not obtained. Another problem is that, in the case of refining a low carbon steel under the above degree of vacuum, C concentration lowers beyond a target concentration according to a product standard, and a supplementary addition of carbon-containing alloys is required after dephosphorizing treatment, leading to increased alloy costs, longer processing time, etc. There is yet another problem with the method that, since the degree of vacuum is controlled in accordance with the C concentration level in the molten steel, the molten steel surface in the ladle fluctuates largely, making the operation difficult.

Further, the problem of high operation costs for steam, electricity, etc. persists with the methods disclosed in the Japanese Unexamined Patent Publication Nos. S62-205221 and H2-122013, since a huge vacuum degassing tank such as that of the RH vacuum degasser is employed therein. These methods also have the problem of high refractory costs, since they have to use a vacuum degassing tank having a sufficient height to cope with the violent splashing during processing.

SUMMARY OF THE INVENTION

An object of the present invention is to solve the above problems of conventional decarburizing treatments and provide a refining method and a refining apparatus capable of producing low carbon steels efficiently and inexpensively, and the gist of the present invention is described in items (1) to (3) below.

(1) A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and decarburizing and refining the molten steel under a reduced pressure, characterized in that the method comprising the steps of; controlling the pressure Pt (Torr) in the cylindrical immersion tube so as to satisfy the following formulae (1) and (2), blowing oxygen gas to the surface of the molten steel through the lance, and decarburizing and refining the molten steel under a reduced pressure;

$$Pt > 760 - 1.297 \times 10^7 / Dc^2 \quad (1)$$

$$K = 1.71 \times Dl^{0.211} \times Dc^{0.438} \times Wm^{-1.124} \times Qg^{0.519} \times Pt^{-0.410} > 0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

(2) A method for refining molten steel according to item (1), characterized by receiving, in a ladle, molten steel having a carbon concentration higher, by 0.03 to 0.06 mass %, than a final target carbon concentration of 0.02 to 0.06 mass % and decarburizing the steel under a reduced pressure.

(3) An apparatus for refining molten steel by providing a cylindrical immersion tube whose lower opening end is immersed into the molten steel above a ladle containing the molten steel in a manner to move vertically, sucking up the molten steel into the cylindrical immersion tube, and decarburizing and refining the molten steel under a reduced pressure, characterized by; a lance for blowing oxygen gas to the surface of the molten steel at the upper portion of the cylindrical immersion tube, a pressure control means for controlling the pressure Pt (Torr) in the cylindrical immersion tube so as to satisfy the following formulae (1) and (2) at the upper portion or a side portion of the cylindrical immersion tube, and an agitation gas injection means provided at the bottom portion of the ladle for injecting the gas from the bottom of the ladle to agitate the molten steel so that said gas passes through the surface of the molten steel in the cylindrical immersion tube;

$$Pt>760-1.297\times10^{7}/Dc^{2} \quad (1)$$

$$K=1.71\times Dl^{0.211}\times Dc^{0.438}\times Wm^{-1.124}\times Qg^{0.519}\times Pt^{-0.410}>0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

Another object of the present invention is to solve the above problems of conventional desulfurizing treatments and provide a molten steel refining method capable of desulfurizing molten steel efficiently and inexpensively, and the gist of the present invention is described in item (4) below.

(4) A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and desulfurizing and refining the molten steel under a reduced pressure, characterized in that the method comprising the steps of; controlling the pressure in the cylindrical immersion tube to the range of 100 to 500 Torr, controlling the injection amount of the agitation gas to the range of 0.6 to 3.0 Nl/min.·t, blowing a desulfurizing agent in powder form, together with a carrier gas, through the lance to the molten steel surface, and desulfurizing and refining the molten steel under a reduced pressure.

A further object of the present invention is to solve the above problems of conventional dephosphorizing treatments and provide a refining method of low carbon steels capable of dephosphorizing molten steel efficiently and inexpensively, and the gist of the present invention is described in item (5) below.

(5) A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and dephosphorizing and refining the molten steel under a reduced pressure, characterized in that the method comprising the steps of; controlling the pressure in the cylindrical immersion tube to the range of 100 to 500 Torr, controlling the injection amount of the agitation gas to the range of 0.6 to 3.0 Nl/min.·t, controlling free oxygen in the molten steel to 300 ppm or more, blowing a dephosphorizing agent in powder form, together with a carrier gas, through the lance to the molten steel surface, and dephosphorizing and refining the molten steel under a reduced pressure.

A yet further object of the present invention is to provide a refining apparatus for implementing desulfurizing treatment or dephosphorizing treatment according to the present invention and the gist of the present invention is described in item (6) below.

(6) An apparatus for refining molten steel by providing a cylindrical immersion tube whose lower opening end is immersed into the molten steel above a ladle containing the molten steel in a manner to move vertically, sucking up the molten steel into the cylindrical immersion tube, and desulfurizing or dephosphorizing and refining the molten steel under a reduced pressure, characterized by; the cylindrical immersion tube designed so that its height is 3,500 to 7,500 mm and the ratio of its diameter to the ladle diameter is 0.25 to 0.5, a lance for blowing a desulfurizing or dephosphorizing agent in powder form, together with a carrier gas, to the surface of the molten steel at the upper part of the cylindrical immersion tube, a pressure control means for controlling the pressure in the cylindrical immersion tube to the range of 100 to 500 Torr at the upper portion or a side portion of the cylindrical immersion tube, and an agitation gas injection means provided at the bottom portion of the ladle for injecting the gas from the bottom of the ladle to agitate the molten steel so that said gas passes through the surface of the molten steel in the cylindrical immersion tube.

Figure 1:
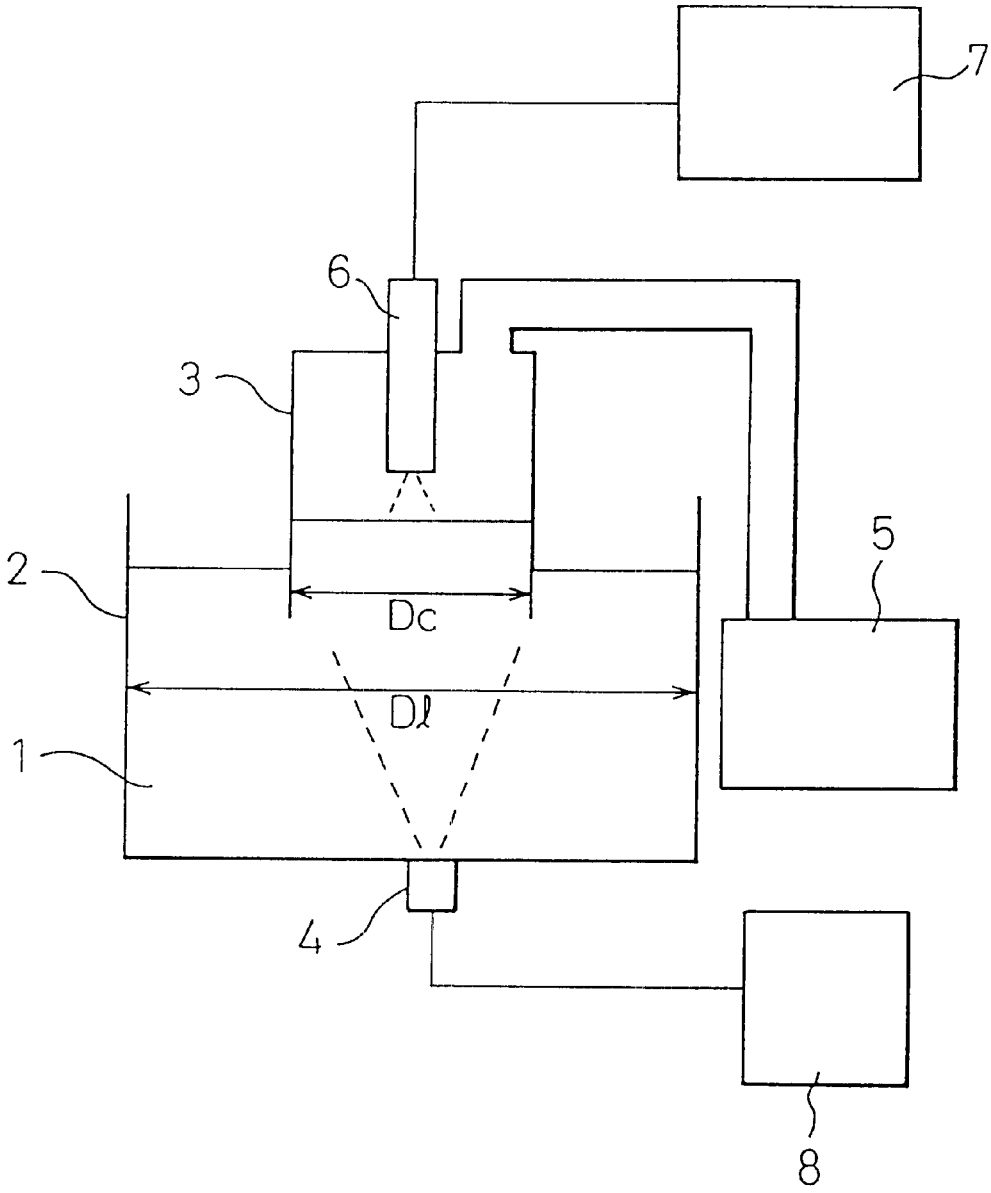
FIG. 1 is a schematic illustration of an example of an apparatus for implementing the methods according to the present invention.

THE MOST PREFERRED EMBODIMENT (1) Preferable embodiments of the refining method and the refining apparatus according to the present invention with regard to decarburization are described hereafter, referring to the drawings.

FIG. 1 shows an apparatus to refine molten steel under a reduced pressure. The following reference numerals in the figure indicate the following apparatuses, respectively: 1 molten steel contained in a ladle 2; 3 a vertically movable cylindrical immersion tube installed above the ladle 2 so that its lower opening end can be immersed into the molten steel 1 in the ladle 2; 4 a tuyere installed at the bottom of the ladle 2 to inject a molten steel agitation gas; 5 a controller of the degree of vacuum as a means to control the pressure in the cylindrical immersion tube 3 to a prescribed value; and 6 a gas blowing or powder blowing lance to blow a gas, or a gas containing a prescribed agent in powder form, towards the surface of the molten steel 1 in the cylindrical immersion tube 3. When the refining apparatus shown in FIG. 1 is used for decarburization, the molten steel 1 is decarburized by blowing a decarburizing gas supplied from a decarburizing gas supplying source 7 through the gas blowing lance 6 from the upper part of the cylindrical immersion tube 3 the lower end of which is immersed in the molten steel 1 in the ladle 2 and, at the same time, by injecting a molten steel agitation gas supplied from an agitation gas supplying source 8 from the bottom of the ladle 2.

Figure 2:
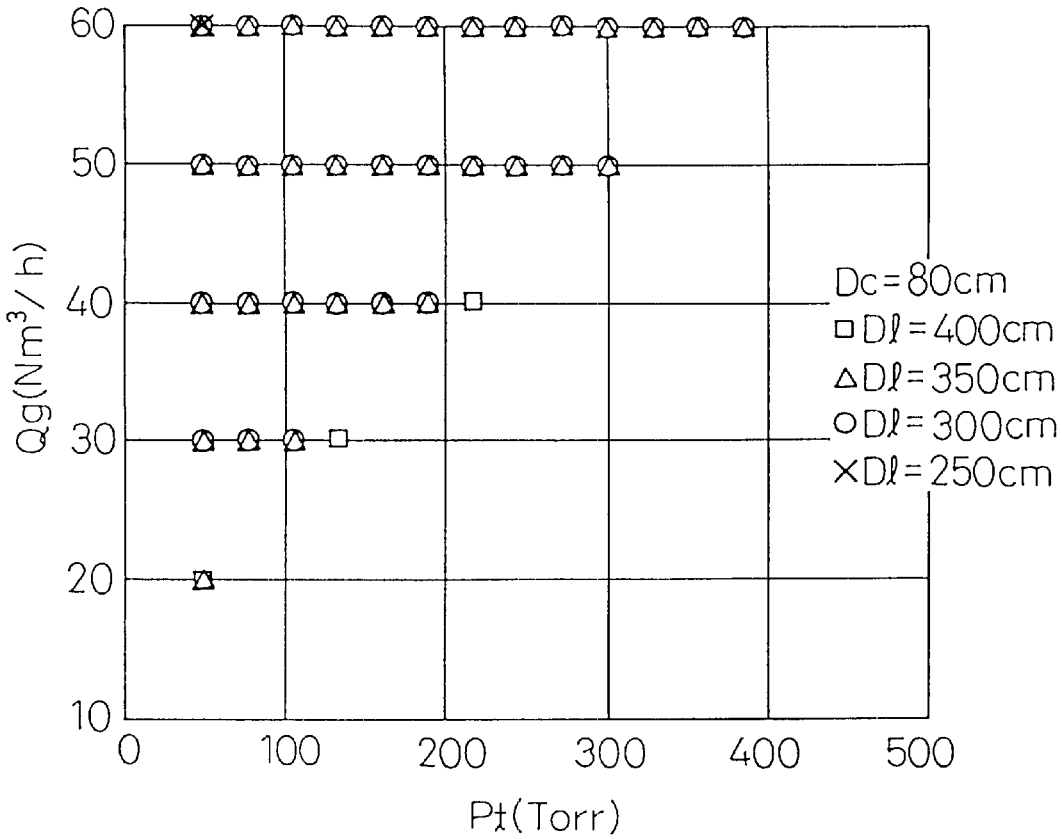
FIG. 2 is a graph showing the relationship between the pressure Pt in the cylindrical immersion tube and the injection amount Qg of the agitation gas in the case that the circle-reduced inner diameter of the cylindrical immersion tube is 80 cm.
Figure 3:
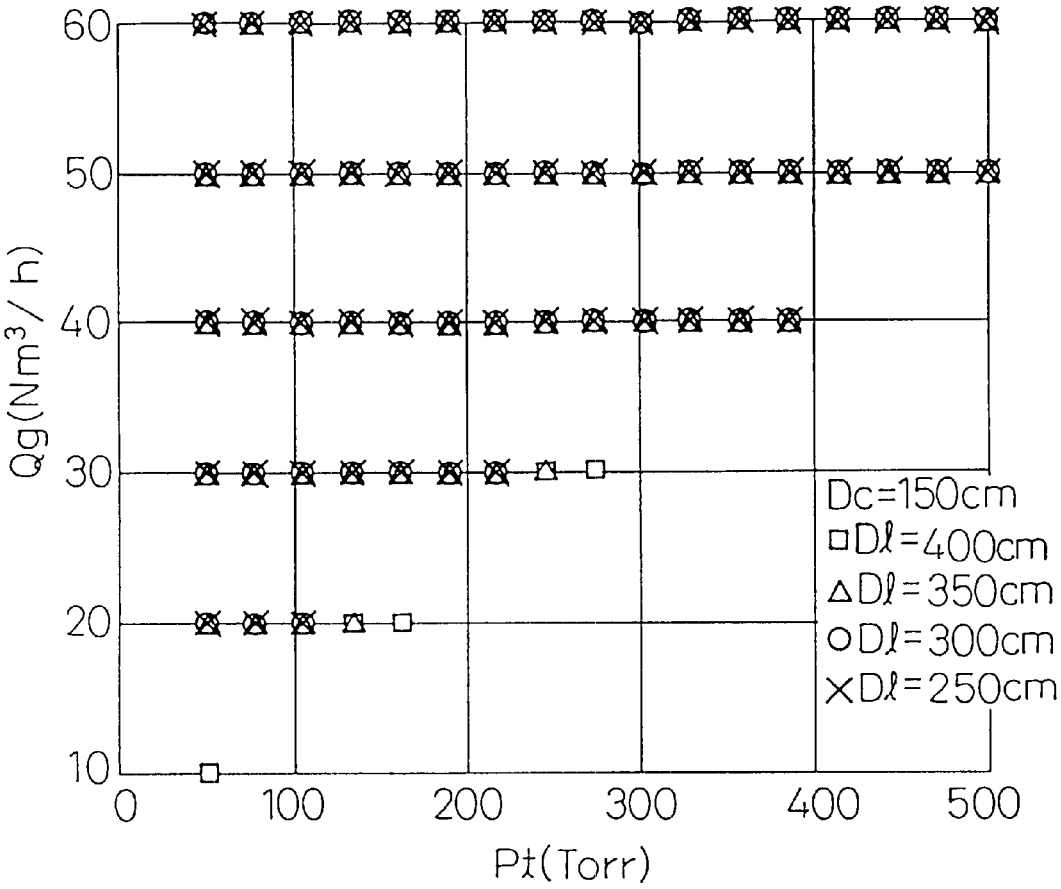
FIG. 3 is a graph showing the relationship between the pressure Pt in the cylindrical immersion tube and the injection amount Qg of the agitation gas in the case that the circle-reduced inner diameter of the cylindrical immersion tube is 150 cm.
Figure 4:
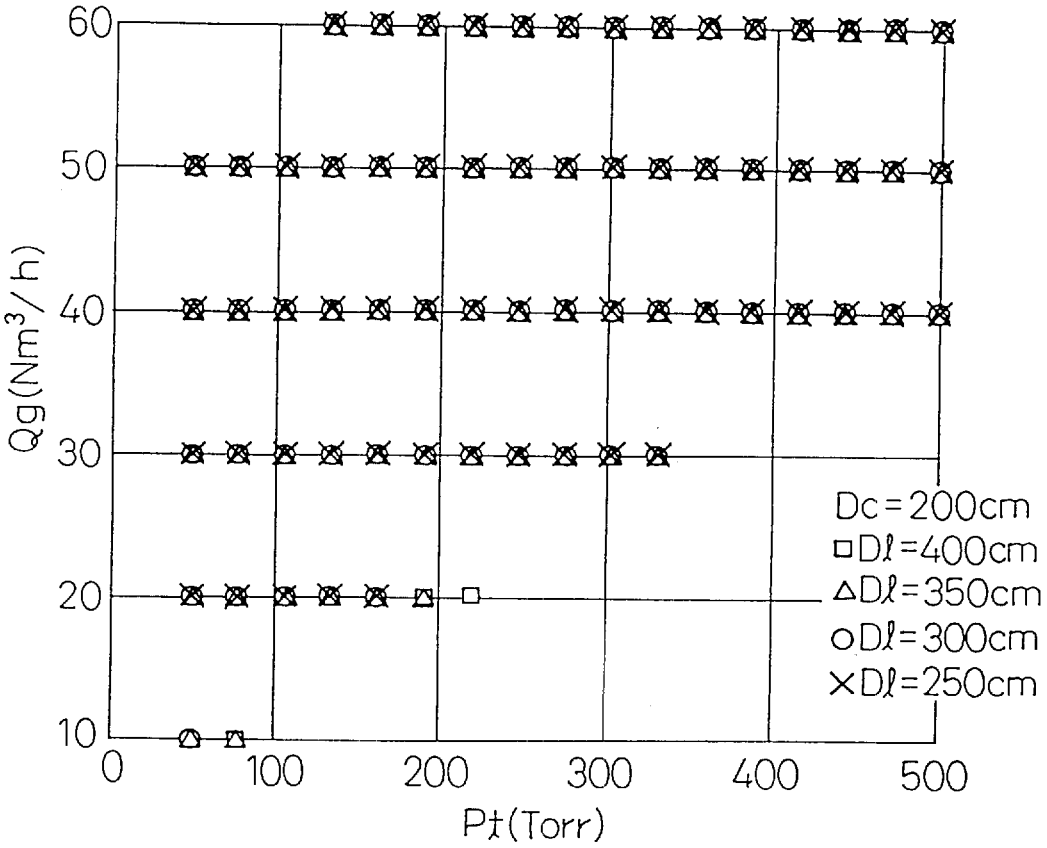
FIG. 4 is a graph showing the relationship between the pressure Pt in the cylindrical immersion tube and the injection amount Qg of the agitation gas in the case that the circle-reduced inner diameter of the cylindrical immersion tube is 200 cm.
Figure 5:
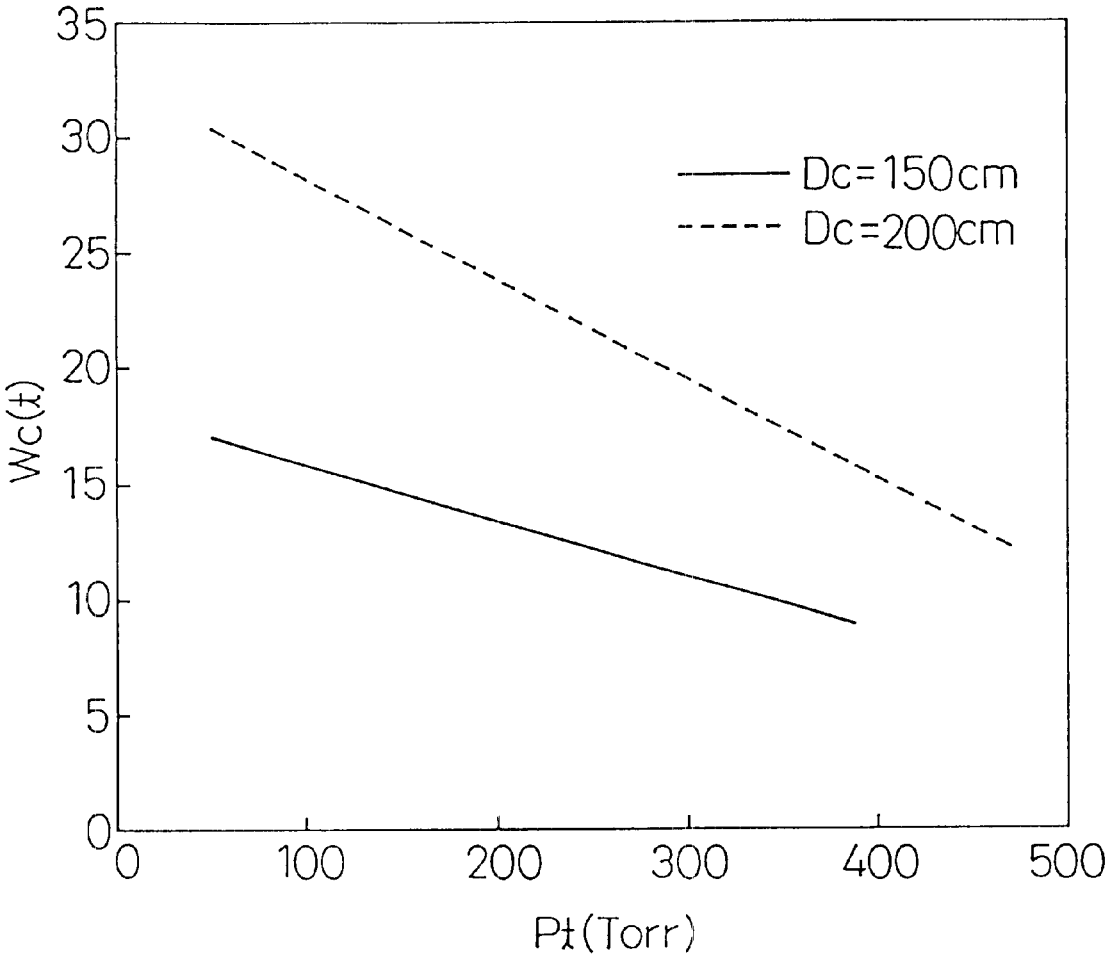
FIG. 5 is a graph showing the relationship between the pressure Pt in the cylindrical immersion tube and the amount Wc of the sucked-up molten steel.

The inventors of the present invention carried out a series of laboratory scale and real scale tests of decarburization by blowing an appropriate amount of oxygen from the decarburizing gas supplying source 7 through the gas blowing lance 6 installed in the cylindrical immersion tube and agitating the molten steel with a bottom-blowing agitation gas supplied from the agitation gas supplying source 8, under different conditions of the mass of molten steel, the inner diameter of the cylindrical immersion tube, the pressure inside the cylindrical immersion tube, the gas injection amount, and the ladle inner diameter. As a consequence, the present inventors obtained the results shown in FIGS. 2, 3 and 4. These figures show the points where a final target carbon concentration of 0.04% is achieved within 10 min. (a time which does not deteriorate productivity) starting from an initial condition of 0.1 mass % of carbon concentration and 0.033 mass % of oxygen concentration, when decarburizing 300 t or so of molten steel.

From these results, the present inventors worked out formula (2) below as an expression of the relationship of a capacity coefficient K (l/min.) of the speed of decarburizing reaction defined by equation (3) below with the amount Wm of molten steel per processing, the ladle inner diameter Dl (cm), the circle-reduced inner diameter Dc (cm) of the cylindrical immersion tube, the injection amount Qg ($Nm^3$/h.) of the agitation gas and the pressure Pt (Torr) in the cylindrical immersion tube.

$$K=1.71\times Dl^{0.211}\times Dc^{0.438}\times Wm^{-1.124}\times Qg^{0.519}\times Pt^{-0.410}>0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

$$K=ln([\%C]_i/[\%C]_f)/t \quad (3)$$

wherein, $[\%C]_i$: carbon concentration before treatment (%)

$[\%C]_f$: carbon concentration after treatment (%)

t: treatment time (min.)

To advance of the decarburizing reaction, it is necessary to agitate oxygen and molten steel, but it is easier and also preferable in terms of the reaction to blow oxygen to the surface of the molten steel in the cylindrical immersion tube 3 through the gas blowing lance 6 installed inside the cylindrical immersion tube 3. This is because the surface of the molten steel in the cylindrical immersion tube 3 is the zone where bubbles of the injected gas rapidly expand and the agitation is the strongest. Hence, a high decarburizing efficiency is obtained by supplying oxygen to the zone.

However, since an excessive supply of oxygen causes a rise in oxygen concentration in molten steel, it is necessary to choose a suitable injection amount not to cause the rise. The more gas is blown in from the bottom, the better, but too much injection results in fusing damage of the injection nozzle or a porous plug. Thus, it is necessary to choose a suitable injection amount in consideration of the molten steel mass per processing, the cylindrical immersion tube diameter, the ladle diameter and pressure setting, etc.

More specifically, the values described below are preferable.

(i) The molten steel mass per processing has to be 350 t or less.

This is because, if it exceeds 350 t, the amount of molten steel is too much in proportion to the area of reaction surface and it becomes difficult to complete decarburization within a short time. Too large an amount of molten steel results in a long decarburization time and a large drop of molten steel temperature, which fact calls for a higher converter tapping temperature and results in increased refractory costs for repairs, etc.

(ii) The inner diameter of a ladle has to be 300 cm or more in terms of circle-reduced diameter.

When the ladle diameter is small, the speed of decarburizing reaction decreases to some extent, because the depth of molten steel in a ladle becomes larger and the static pressure on the bubbles of an injected gas increases, causing the speed of the decarburizing reaction between the injected gas and the molten steel to fall. If the amount of the agitation gas is increased to compensate for the fall in the reaction speed, that will result not only in an increase in the gas cost but also fusion damage of the tuyere or a porous brick for the gas injection. If the agitation gas injection amount is kept unchanged, the decarburization time will increase requiring a higher converter tapping temperature and increased refractory costs, as in the item (i) above.

(iii) The pressure in a cylindrical immersion tube has to be 100 Torr or more and 500 Torr or less.

A low pressure in the cylindrical immersion tube is advantageous for securing the decarburizing reaction speed, but the height of splash becomes larger, requiring a huge refining apparatus having a height of 7 m or more like a conventional RH refining apparatus. When the pressure in the immersion tube exceeds 500 Torr, on the other hand, more gas injection is required for decarburization, resulting in not only an increase in the gas cost but also fusion damage of the tuyere or a porous brick for the gas injection. If the agitation gas amount is not increased, the decarburization time will become longer requiring a higher converter tapping temperature and increased refractory costs, as in the item (i) above.

(iv) The inner diameter of a cylindrical immersion tube has to be 80 cm or more and 200 cm or less.

If the inner diameter of a cylindrical immersion tube is below 80 cm, the area of the reaction surface becomes small and the decarburizing speed falls. If the injection amount of the agitation gas is increased to compensate for the fall in the reaction speed, the height of splashing increases, and a problem of fusion damage to the gas injection tuyere arises. If the agitation gas amount is not increased, the decarburization time will increase requiring a higher converter tapping temperature and increased refractory costs, as in the item (i) above.

If the inner diameter of an immersion tube exceeds 200 cm, the amount of molten steel sucked up into the cylindrical immersion tube increases, requiring larger equipment to support the increased weight and an increase in equipment cost as a consequence. Refractory consumption of the immersion tube also increases and the costs for its repair also increases.

Under the conditions stated in items (iii) and (iv), the amount of molten steel sucked up into the cylindrical immersion tube decreases and the vertical movement of the vacuum tank becomes easier, requiring only simple equipment. This means that an expensive ladle lifting apparatus like the ones used in the conventional RH vacuum degassers is not necessary. The splash height can be suppressed by controlling the pressure in the cylindrical immersion tube within the range of 100 to 500 Torr. Further, since the inner diameter of the cylindrical immersion tube is 80 to 200 cm, smaller than conventional decompression refining apparatuses, unit consumption of the refractory is smaller and its repair work easier.

A sufficient gas injection amount can be secured with the one porous brick conventionally used in a ladle, and it is not necessary to add a new gas injection hole or use a special porous brick or lance for the decarburization processing according to the present invention.

Further, when producing a low carbon steel having a final target carbon concentration of 0.02 to 0.06 mass %, efficient refining is possible by stopping the converter blowing at a carbon concentration higher, by 0.03 to 0.06 mass % or so, than a target carbon concentration and then decarburizing the steel under a reduced pressure using the refining method and apparatus according to the present invention. Molten steel, lower in carbon concentration than that obtainable by the conventional decarburization processing by a converter to hit the target carbon concentration in one step, can thus be obtained more inexpensively.

(2) Preferable embodiments of the refining method and the refining apparatus according to the present invention with regard to desulfurization are described hereafter referring to the drawings.

A refining apparatus of the same type as shown in FIG. 1 is used. In the refining apparatus shown in FIG. 1, the degree of vacuum inside the cylindrical immersion tube 3 is controlled within the range of 100 to 500 Torr by the controller of the degree of vacuum 5. The molten steel 1 is desulfurized by controlling the degree of vacuum inside the cylindrical immersion tube 3 within the range of 100 to 500 Torr as stated above and the amount of molten steel agitation gas injected through the tuyere 4 within the range of 0.6 to 3.0 Nl/min.·t. The desulfurization processing according to the present invention described above is based on the finding that, for producing ultra low carbon steels, it is important to intensify agitation of (1) the portion of molten steel where powder is injected and (2) the entire molten steel in a ladle. When a desulfurizing agent is injected into molten steel, a desulfurizing reaction proceeds while the agent is suspended in the molten steel. Here, if agitation is intensified in the portion where the powder is injected, that is, if molten steel is agitated especially under a reduced pressure, the agitation by gas expansion under the reduced pressure is added to the agitation by the agitation gas alone, resulting in an acceleration of the desulfurizing reaction, compared with that under normal pressure, due to the intensified agitation. Removal of locally desulfurized molten steel from the powder injected portion and a quick supply of fresh molten steel to that portion by the intensified agitation prevent the desulfurization reaction rate from being determined by the movement velocity of S in the molten steel to the desulfurizing reaction surface.

By the refining method of the present invention, as described above, the molten steel 1 is desulfurized under the conditions of a degree of vacuum in the cylindrical tube 3 of 100 to 500 Torr and an injection amount of the gas for agitating molten steel of 0.6 to 3.0 Nl/min.·t. The reason why the degree of vacuum inside the cylindrical tube 3 is controlled within the range of 100 to 500 Torr is as follows. If the degree of vacuum exceeds 500 Torr, the steel agitation at the powder injected portion becomes insufficient making it impossible to lower the S concentration in the molten steel to 10 ppm or less. When the degree of vacuum is below 100 Torr, on the other hand, a huge vacuum degassing tank of a sufficient height is required to cope with violent splashing during the desulfurization processing, resulting in undesirably high operation costs.

Further, the reason why the injection amount of the gas for agitating molten steel is controlled to the range of 0.6 to 3.0 Nl/min.·t is as follows. When the gas is injected at a rate exceeding 3.0 Nl/min.·t through a commonly used porous brick, fusion damage to the brick is so advanced that its service life becomes short and, besides, slag on the molten steel surface is greatly stirred by strong rocking motion of the molten steel in the ladle, making it impossible to decrease S concentration in the molten steel to 10 ppm or lower. If the gas injection amount is below 0.6 Nl/min.·t, mixing of the entire molten steel becomes too weak, making it impossible to decrease S concentration in the molten steel to 10 ppm or lower.

For more efficient desulfurizing treatment, a cylindrical immersion tube 3 has to be so designed that its height is 3,500 to 7,500 mm and the ratio of its diameter to the ladle diameter is 0.25 to 0.5. The reason for this is as follows: when the height of the cylindrical immersion tube 3 is below 3,500 mm and the ratio of its diameter to the ladle diameter is below 0.25, the yield of molten steel is lowered and the refining operation becomes unstable due to an increase in the amount of skulls sticking onto the inner wall of the cylindrical immersion tube as a result of splash during the processing; when the height of the cylindrical immersion tube 3 exceeds 7,500 mm and the ratio of its diameter to the ladle diameter exceeds 0.5, the size of the entire apparatus becomes nearly as large as a vacuum degasser such as an RH refining apparatus, resulting in undesirably high operation costs.

(3) Preferable embodiments of the refining method and the refining apparatus according to the present invention with regard to dephosphorization are described hereafter referring to the drawings.

A refining apparatus of the same type as shown in FIG. 1 is used. In the refining apparatus shown in FIG. 1, the degree of vacuum inside the cylindrical immersion tube 3 is controlled within the range of 300 to 500 Torr by the controller of the degree of vacuum 5. The molten steel 1 is dephosphorized by controlling the degree of vacuum inside the cylindrical immersion tube 3 to within the range of 300 to 500 Torr as stated above, the amount of molten steel agitation gas injected through the tuyere 4 to within the range of 0.6 to 3.0 Nl/Nl/min.·t, and free oxygen in the molten steel to 300 ppm or more. The dephosphorization processing according to the present invention as described above is based on the finding that it is important to intensify agitation of (1) the portion of molten steel where powder is injected and (2) the entire molten steel in a ladle. When a dephosphorizing agent is injected into molten steel, dephosphorizing reaction proceeds while the agent is suspended in the molten steel. Here, if steel agitation is intensified in the portion where the powder is injected, that is, if molten steel is agitated especially under a reduced pressure, the agitation by gas expansion under the reduced pressure is added to the agitation by the agitation gas alone, resulting in an acceleration of the dephosphorizing reaction, compared to that under the normal pressure, due to the intensified agitation.

By the refining method of the present invention, as described above, the molten steel is dephosphorized under the conditions of a degree of vacuum in the cylindrical tube 3 of 300 to 500 Torr, an injection amount of the gas for agitating molten steel of 0.6 to 3.0 Nl/min.·t, and free oxygen in the molten steel of 300 ppm or more. The reason why the degree of vacuum in the cylindrical tube 3 is controlled within the range of 300 to 500 Torr is as follows. If the degree of vacuum exceeds 500 Torr, the steel agitation at the powder injected portion is insufficient and the dephosphorizing reaction becomes very slow. When the degree of vacuum is below 300 Torr, on the other hand, the decarburizing reaction proceeds preferentially causing undesirable effects such as slowing down of the dephosphorizing reaction, a supplementary addition of carbon-containing alloys after the dephosphorizing treatment due to over-reduction of C concentration of the molten steel beyond the C concentration by the product standard, and an increase in operation costs because of a huge vacuum degassing tank of a sufficient height required for coping with violent splashing occurring during the dephosphorizing treatment.

Further, the reason why the amount of the gas for agitating molten steel is controlled within the range of 0.6 to 3.0 Nl/min.·t is as follows. When the gas is injected at a rate exceeding 3.0 Nl/min.·t through a commonly used porous brick, fusion damage to the brick becomes so advanced that its service life becomes short and, besides, a rocking motion of the molten steel in the ladle becomes too strong to secure stable operation.

If the gas injection amount is below 0.6 Nl/min.·t, mixing of the entire molten steel becomes too weak and the dephosphorizing reaction slows down remarkably. The reason why free oxygen in the molten steel has to be kept at 300 ppm or more is that, when the free oxygen is below 300 ppm, the dephosphorizing reaction slows down remarkably due to insufficient free oxygen.

For more efficient dephosphorizing treatment, the cylindrical immersion tube 3 has to be so designed that its height is 3,500 to 7,500 mm and the ratio of its diameter to the ladle diameter is 0.25 to 0.5. The reason for this is as follows: when the height of the cylindrical immersion tube is below 3,500 mm and the ratio of the immersion tube diameter to the ladle diameter is below 0.25, the molten steel yield is lowered and the refining operation becomes unstable due to an increase in the amount of skulls sticking onto the inner wall of the cylindrical immersion tube as a result of splash during the processing; when the height of the cylindrical immersion tube 3 exceeds 7,500 mm and the ratio of its diameter to the ladle diameter exceeds 0.5, the size of the entire apparatus becomes nearly as large as a vacuum degasser such as an RH refining apparatus, resulting in undesirably high operation costs.

EXAMPLES

Example I

This example relates to decarburizing treatment.

For the purpose of producing a low carbon steel having a final carbon concentration of 0.04%, Inventive Example 1 in Table 1 was prepared as follows: 292 t of molten steel was tapped to a ladle from a converter, after stopping blowing, at a carbon concentration of 0.07%, and it then underwent a decarburizing treatment for 9 min. using a refining apparatus shown in FIG. 1 with an inner diameter of the cylindrical immersion tube of 165 cm, a ladle inner-diameter of 400 cm, a pressure in the cylindrical immersion tube of 300 Torr and a bottom blowing gas amount of 37 $Nm^3/h$. The molten steel decarburized under the above condition was then deoxidized with an aluminum addition to finally obtain a molten steel having a carbon concentration of 0.04%. The yield of aluminum at this treatment was 93% and that of manganese ore at the converter was 65%.

Inventive Example 2 in Table 1 was prepared as follows: 260 t of molten steel was tapped to a ladle from a converter, after stopping blowing, at a carbon concentration of 0.08%, and it then underwent a decarburizing treatment for 12 min. with oxygen blowing through the top blowing lance under the condition of an inner diameter of the cylindrical immersion tube of 86 cm, a ladle inner diameter of 400 cm, a pressure in the cylindrical immersion tube of 200 Torr and a gas injection amount of 40 $Nm^3/h$., to achieve a final carbon concentration of 0.04%. The steel thus obtained was finally deoxidized with an aluminum addition. The yield of aluminum at this treatment was 94% and the reduction yield of manganese ore at the converter was 68%.

Comparative Example 1 in Table 1 was prepared by decarburizing 290 t of molten steel melted in a converter having a carbon concentration of 0.07%. The decarburization condition was as follows: a ladle inner diameter of 250 cm, an inner diameter of the cylindrical immersion tube of 70 cm, and a gas injection amount of 50 $Nm^3/h$. In this case no pressure controller was used and the refining proceeded under the normal atmospheric pressure for 20 min., resulting in a carbon concentration reduction only to 0.05% and, adversely, a rise in oxygen concentration. At an aluminum addition thereafter for deoxidation, the yield of aluminum was as low as 68%.

Comparative Example 2 in Table 1 is an example of a case that a conventional RH vacuum degasser was used and it was prepared by decarburizing a molten steel melted in a converter to a carbon concentration of 0.08%. After a decarburizing treatment for 6 min., a carbon concentration of 0.04% was attained. More steam and electricity were consumed in this case than in the examples of the present invention.

Comparative Example 3 in Table 1 is an example of a case that carbon concentration was brought down to 0.04% through decarburization in one step in a conventional converter. In this case both the manganese yield and the aluminum yield were low.

TABLE 1

| | After refining by converter | | | | | | | | Secondary refining | | | | | | | | |
|---|---|---|---|---|---|---|---|---|---|---|---|---|---|---|---|---|---|
| | Chemical composition of molten steel (%) | | | | | | FeO in slag | Mn yield | Molten steel chemical composition after decarburization (%) | | | | | | Al yield | Electricity consumption | Steam consumption |
| | C | Si | Mn | P | S | O | (%) | (%) | C | Si | Mn | P | S | O | (%) | (kWh/l) | (kg/l) |
| Inventive Example 1 | 0.07 | tr | 0.24 | 0.015 | 0.011 | 0.034 | 13.7 | 65 | 0.04 | tr | 0.24 | 0.015 | 0.011 | 0.034 | 93 | 0.11 | 0 |
| Inventive Example 2 | 0.08 | tr | 0.25 | 0.014 | 0.012 | 0.032 | 12.5 | 68 | 0.04 | tr | 0.25 | 0.014 | 0.012 | 0.032 | 94 | 0.13 | 0 |
| Comparative Example 1 | 0.07 | tr | 0.24 | 0.016 | 0.012 | 0.032 | 12.2 | 64 | 0.05 | tr | 0.18 | 0.016 | 0.012 | 0.042 | 68 | 0.10 | 0 |
| Comparative Example 2 | 0.08 | tr | 0.26 | 0.015 | 0.013 | 0.031 | 11.8 | 65 | 0.04 | tr | 0.26 | 0.015 | 0.013 | 0.031 | 88 | 8.0 | 3.2 |
| Comparative Example 3 | 0.04 | tr | 0.19 | 0.015 | 0.013 | 0.056 | 12.1 | 38 | 0.04 | tr | 0.19 | 0.015 | 0.013 | 0.056 | 62 | 0 | 0 |

Example II

Molten steel 1 having 26 ppm of S concentration was desulfurized using a refining apparatus shown in FIG. 1 as a desulfurizing reaction vessel. A cylindrical immersion tube 3 immersed in a ladle 2 had an inner diameter of 1.5 m and a height of 4.5 m, and the pressure inside the tube 3 was kept at 200 Torr by a controller of the degree of vacuum 5. The molten steel 1 was agitated with Ar gas, for agitating the molten steel, injected through a tuyere 4 at the bottom of the ladle 2 at a rate of 1.8 Nl/min.·t and, in parallel, it was desulfurized with a desulfurizing agent in powder form injected at a rate of 5 kg/t together with a carrier gas through a powder injection lance 6. The result is shown in Table 2. It was confirmed that S concentration [S] in the molten steel was reduced from 26 ppm before the desulfurization to 5 ppm thereafter and that the desulfurization proceeded efficiently and with a low operating cost.

Table 2 also shows comparative examples: Comparative Example 1 is a case that desulfurization was done using a conventional RH vacuum degasser injecting a desulfurizing agent in powder form at a rate of 4.5 kg/t. In this case, the [S] concentration was reduced from 28 ppm before the desulfurization to 6 ppm thereafter, but with a very high operating cost.

Comparative Example 2 in Table 2 is a case that the desulfurizing reaction vessel according to the present invention was used, injecting a desulfurizing agent in powder form at a rate of 3 kg/t together with a carrier gas through a lance, but under the atmospheric pressure (760 Torr) without using a controller of the degree of vacuum. In this case, the [S] concentration was reduced from 31 ppm before the desulfurization only to 26 ppm thereafter, failing to attain a target of [S]≦10 ppm.

TABLE 2

| | Desulfurizing reaction vessel | Degree of vacuum (Torr) | [S] before desulfurization (ppm) | [S] after desulfurization (ppm) | Amount of desulfurizing agent (kg/t) |
|---|---|---|---|---|---|
| Inventive Example | The one as shown in FIG. 1 | 200 | 26 | 5 | 5 |
| Comparative Example 1 | RH | 1 | 28 | 6 | 4.5 |
| Comparative Example 2 | The one as shown in FIG. 1 | 760 | 31 | 26 | 3 |

Example III

Molten steel 1 having 340 ppm of free oxygen and 96 ppm of P concentration was dephosphorized using a refining apparatus shown in FIG. 1 as a dephosphorizing reaction vessel. A cylindrical immersion tube 3 immersed in a ladle 2 had an inner diameter of 1.5 m and a height of 4.5 m, and the pressure inside the cylindrical immersion tube 3 was kept at 350 Torr by a controller of the degree of vacuum 5. The molten steel 1 was agitated with Ar gas, for agitating molten steel, injected through a tuyere at the bottom of the ladle 2 at a rate of 1.8 Nl/min.·t and, in parallel, a dephosphorizing agent in powder form was injected at a rate of 4 kg/t together with a carrier gas through a powder injection lance 6. The result is shown in Table 3. It was confirmed that P concentration [P] in the molten steel was reduced from 96 ppm before the dephosphorization to 22 ppm thereafter and that the treatment proceeded efficiently and with a low operating cost.

Table 3 also shows comparative examples: Comparative Example 1 is a case that a conventional RH vacuum degasser was used with a dephosphorizing agent in powder form injected at a rate of 4 kg/t. In this case, [P] concentration was reduced from 100 ppm before the desulfurization to 25 ppm thereafter, but with a very high operating cost.

Comparative Example 2 in Table 3 is a case that a dephosphorizing reaction vessel according to the present invention was used with the dephosphorizing agent in powder form injected at a rate of 4 kg/t together with a carrier gas through a lance to treat a molten steel having 194 ppm of free oxygen. In this case, [P] concentration was reduced from 110 ppm before the dephosphorization to 95 ppm thereafter, but at a very slow dephosphorization speed.

Comparative Example 3 in Table 3 is a case that the dephosphorizing reaction vessel according to the present invention was used with the dephosphorizing agent in powder form injected at a rate of 4 kg/t together with a carrier gas through a lance, but under the atmospheric pressure (760 Torr) without using a controller of the degree of vacuum. In this case, [P] concentration was reduced from 92 ppm before the dephosphorization to 83 ppm thereafter, but at a very slow dephosphorization speed.

TABLE 3

| | Dephosphorizing reaction vessel | Degree of vacuum (Torr) | Free oxygen (ppm) | [P] before dephosphorization (ppm) | [P] after dephosphorization (ppm) | Amount of dephosphorizing agent (kg/t) |
|---|---|---|---|---|---|---|
| Inventive Example | The one as shown in FIG. 1 | 350 | 340 | 96 | 22 | 4 |
| Comparative Example 1 | RH | 80 | 400 | 100 | 25 | 4 |
| Comparative Example 2 | The one as shown in FIG. 1 | 350 | 190 | 110 | 95 | 4 |
| Comparative Example 3 | The one as shown in FIG. 1 | 760 | 450 | 92 | 83 | 4 |

INDUSTRIAL AVAILABILITY

The method and apparatus to refine molten steel according to the present invention are capable of decarburizing, desulfurizing or dephosphorizing molten steel, especially that of low carbon steels, efficiently and with a low operating cost. Thus the present invention provides a useful refining method of steel production and an apparatus therefor.

What is claimed is:

1. A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and decarburizing and refining the molten steel under a reduced pressure, characterized in that the method comprising the steps of;

controlling the pressure Pt (Torr) in the cylindrical immersion tube so as to satisfy the following formulae (1) and (2), blowing oxygen gas to the surface of the molten steel through the lance, and decarburizing and refining the molten steel under a reduced pressure;

$$Pt>760-1.297\times10^{7}/Dc^{2} \quad (1)$$

$$K=1.71\times Dl^{0.211}\times Dc^{0.438}\times Wm^{-1.124}\times Qg^{0.519}\times Pt^{-0.410}>0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

2. A method for refining molten steel according to claim 1, characterized by receiving, in a ladle, molten steel having a carbon concentration higher, by 0.03 to 0.06 mass %, than a final target carbon concentration of 0.02 to 0.06 mass % and decarburizing the steel under a reduced pressure.

3. A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and desulfurizing and refining the molten steel under a reduced pressure, characterized in that the method comprising the steps of;

controlling the pressure in the cylindrical immersion tube to the range of 100 to 500 Torr, controlling the injection amount of the agitation gas to the range of 0.6 to 3.0 Nl/min.·t, blowing a desulfurizing agent in powder form, together with a carrier gas, through the lance to the molten steel surface, and desulfurizing and refining the molten steel under a reduced pressure.

4. A method for refining molten steel by immersing the lower opening end of a cylindrical immersion tube equipped with a lance into the molten steel contained in a ladle, controlling the pressure in the cylindrical immersion tube to a prescribed pressure range to suck up the molten steel, injecting an agitation gas from the bottom of the ladle towards the surface of the sucked-up molten steel, and dephosphorizing and refining the molten steel under a reduced pressure, characterized in that the method comprising the steps of;

controlling the pressure in the cylindrical immersion tube to the range of 100 to 500 Torr, controlling the injection amount of the agitation gas to the range of 0.6 to 3.0 Nl/min.·t, controlling free oxygen in the molten steel to 300 ppm or more, blowing a dephosphorizing agent in powder form, together with a carrier gas, through the lance to the molten steel surface, and dephosphorizing and refining the molten steel under a reduced pressure.

5. An apparatus for refining molten steel by providing a cylindrical immersion tube whose lower opening end is immersed into the molten steel above a ladle containing the molten steel in a manner to move vertically, sucking up the molten steel into the cylindrical immersion tube, and decarburizing and refining the molten steel under a reduced pressure, characterized by;

a lance for blowing oxygen gas to the surface of the molten steel at the upper portion of the cylindrical immersion tube, a pressure control means for controlling the pressure Pt (Torr) in the cylindrical immersion tube so as to satisfy the following formulae (1) and (2) at the upper portion or a side portion of the cylindrical immersion tube, and an agitation gas injection means provided at the bottom portion of the ladle for injecting the gas from the bottom of the ladle to agitate the molten steel so that said gas passes through the surface of the molten steel in the cylindrical immersion tube;

$$Pt > 760 - 1.297 \times 10^7 / Dc^2 \quad (1)$$

$$K = 1.71 \times Dl^{0.211} \times Dc^{0.438} \times Wm^{-1.124} \times Qg^{0.519} \times Pt^{-0.410} > 0.046 \quad (2)$$

wherein,

K: capacity coefficient concerning the decarburizing reaction (l/min.)

Dl: inner diameter of the ladle (cm)

Dc: circle-reduced diameter of the cylindrical immersion tube (cm)

Wm: mass of molten steel per processing (t)

Qg: quantity of agitation gas injection ($Nm^3$/h.).

6. An apparatus for refining molten steel by providing a cylindrical immersion tube whose lower opening end is immersed into the molten steel above a ladle containing the molten steel in a manner to move vertically, sucking up the molten steel into the cylindrical immersion tube, and desulfurizing or dephosphorizing and refining the molten steel under a reduced pressure, characterized by;

the cylindrical immersion tube designed so that its height is 3,500 to 7,500 mm and the ratio of its diameter to the ladle diameter is 0.25 to 0.5, a lance for blowing a desulfurizing or dephosphorizing agent in powder form, together with a carrier gas, to the surface of the molten steel at the upper part of the cylindrical immersion tube, a pressure control means for controlling the pressure in the cylindrical immersion tube to the range of 100 to 500 Torr at the upper portion or a side portion of the cylindrical immersion tube, and an agitation gas injection means provided at the bottom portion of the ladle for injecting the gas from the bottom of the ladle to agitate the molten steel so that said gas passes through the surface of the molten steel in the cylindrical immersion tube.

* * * * *